US010862242B2

(12) United States Patent
Nguyen Nhu et al.

(10) Patent No.: US 10,862,242 B2
(45) Date of Patent: Dec. 8, 2020

(54) PLUG CONNECTOR AND PLUG-CONNECTOR RECEPTACLE

(71) Applicant: TE Connectivity Germany GmbH, Bensheim (DE)

(72) Inventors: Lam Nguyen Nhu, Bensheim (DE); Christian Mandel, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/262,344

(22) Filed: Jan. 30, 2019

(65) Prior Publication Data

US 2019/0237903 A1 Aug. 1, 2019

(30) Foreign Application Priority Data

Jan. 30, 2018 (DE) ..... 10 2018 101 964

(51) Int. Cl.

| | |
|---|---|
| ***H01R 13/627*** | (2006.01) |
| ***H01R 13/46*** | (2006.01) |
| ***H01R 13/631*** | (2006.01) |
| ***H01R 13/506*** | (2006.01) |
| ***H01R 13/6592*** | (2011.01) |

(52) U.S. Cl.

CPC ..... *H01R 13/6272* (2013.01); *H01R 13/465* (2013.01); *H01R 13/506* (2013.01); *H01R 13/6271* (2013.01); *H01R 13/631* (2013.01); *H01R 13/6592* (2013.01)

(58) Field of Classification Search

CPC . H01R 13/465; H01R 13/6592; H01R 13/641

USPC ..... 439/357, 488, 491

See application file for complete search history.

(56) References Cited

U.S. PATENT DOCUMENTS 2,962,688 A * 11/1960 Werner ..... H01R 13/5219 439/320
3,552,777 A * 1/1971 Heinrich et al. ..... F16L 19/00 285/81
4,243,290 A * 1/1981 Williams ..... H01R 9/032 439/607.52
4,284,313 A * 8/1981 Anhalt ..... H01R 13/6271 439/350
4,407,529 A * 10/1983 Holman ..... H01R 13/622 285/388

(Continued)

FOREIGN PATENT DOCUMENTS

CN 206004065 * 3/2017
DE 558666 A 9/1932

(Continued)

OTHER PUBLICATIONS

German Office Action, Application No. 10 2018 101 964.5, dated Sep. 12, 2018, 6 pages.

(Continued)

*Primary Examiner* — Peter G Leigh
(74) *Attorney, Agent, or Firm* — Barley Snyder

(57) ABSTRACT

A plug connector for electrically and mechanically connecting a pair of electrical conductors of a line comprises an insulator and a housing receiving the insulator. The insulator receives and positions a pair of end sleeves each connected to one of the electrical conductors. The housing has a plurality of plug orientations each visually and haptically denoted by a marking in a grip region of the housing.

17 Claims, 4 Drawing Sheets

(56) References Cited

U.S. PATENT DOCUMENTS

| | | | | | |
|---|---|---|---|---|---|
| 4,596,431 | A * | 6/1986 | Burns | H01R 13/631 | 439/314 |
| 4,921,449 | A * | 5/1990 | Fish | H01R 9/032 | 439/585 |
| 5,368,499 | A * | 11/1994 | Hirt | H01R 13/6271 | 439/281 |
| 5,435,760 | A * | 7/1995 | Miklos | H01R 13/516 | 285/92 |
| 5,641,310 | A * | 6/1997 | Tiberio, Jr. | H01R 13/625 | 439/680 |
| 5,888,097 | A * | 3/1999 | DiCicco | H01R 9/032 | 439/589 |
| 6,022,237 | A * | 2/2000 | Esh | H01R 13/5219 | 439/348 |
| 6,048,227 | A * | 4/2000 | Rupp | H01R 9/0521 | 439/607.41 |
| 7,306,483 | B2 * | 12/2007 | Phillips | H01R 11/11 | 439/568 |
| 7,416,448 | B2 * | 8/2008 | Gaidosch | H01R 9/031 | 439/607.41 |
| 9,209,565 | B2 * | 12/2015 | Michel | H01R 13/508 | |
| 2012/0190238 | A1 * | 7/2012 | Omae | H01R 13/6592 | 439/620.01 |

FOREIGN PATENT DOCUMENTS

| | | | |
|---|---|---|---|
| GB | 2361113 | A | 10/2001 |
| GB | 2398934 | A | 9/2004 |

OTHER PUBLICATIONS

French Patent Office Search Report, French Patent Application No. FR1900573, dated Nov. 8, 2019, 8 pages.

* cited by examiner

PLUG CONNECTOR AND PLUG-CONNECTOR RECEPTACLE

CROSS-REFERENCE TO RELATED APPLICATION

This application claims the benefit of the filing date under 35 U.S.C. § 119(a)-(d) of German Patent Application No. 102018101964.5, filed on Jan. 30, 2018.

FIELD OF THE INVENTION

The present invention relates to a plug connector and, more particularly, to a plug connector for electrically and mechanically connecting a pair of electrical conductors of a line.

BACKGROUND

Plug connectors are used for producing a detachable electrically conductive connection to a bushing or a coupler. As a function of a field of application, plug connectors are often designed in a polarized manner. In this case, the plug connectors have a defined orientation in the plugged-together state, by which reverse polarization of the electrical contacts, which can be connected to each other, is prevented. Conventionally, projections or tongue-and-groove connections are used in order to implement polarization of a plug connection.

A plug connection for electrically conductively connecting several electrical lines with a plug connector and a coupler is described in U.S. Pat. No. 4,284,313 A. The plug connection is cylindrical in design and has several tongue-and-groove connections arranged around the circumference, so that reverse polarization is prevented. The tongues or the projections are arranged at the plug and can be pushed in a latching manner into the respective recesses of the coupler.

The disadvantage of such plug connections, however, is that clear alignment of the components of the plug connection is awkward when the plug and the coupler are plugged together manually. As a result, repeated positioning of the components may be necessary until an accurate alignment and thus an accurate matching of the tongue-and-groove connection is achieved.

SUMMARY

A plug connector for electrically and mechanically connecting a pair of electrical conductors of a line comprises an insulator and a housing receiving the insulator. The insulator receives and positions a pair of end sleeves each connected to one of the electrical conductors. The housing has a plurality of plug orientations each visually and haptically denoted by a marking in a grip region of the housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
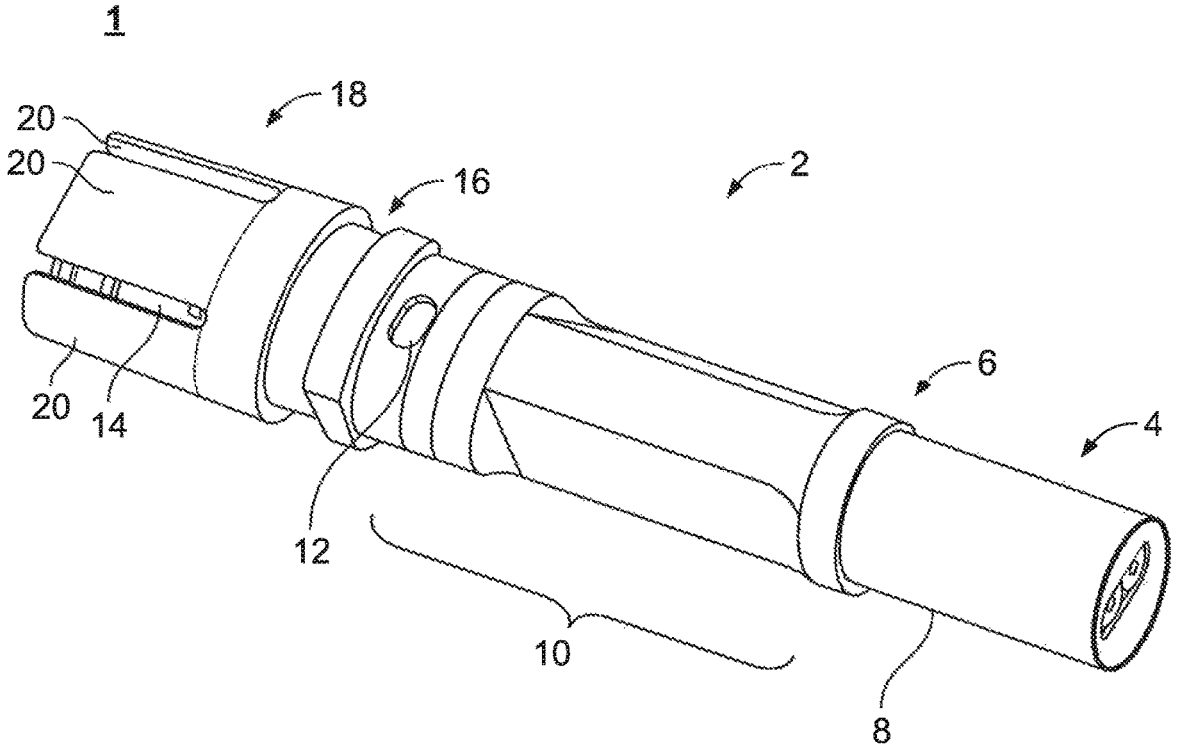
FIG. 1 is a rear perspective view of a plug connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

A plug connector 1 according to an embodiment is shown in FIG. 1. The plug connector 1 has a housing 2 with an elongated shape and an oval cross-section at least in some regions. The housing 2 is formed of an electrically conductive material, such as copper, aluminum, silver, stainless steel, a metal alloy or the like.

As shown in FIG. 1, the housing 2 has an overlapping region 6 that extends over a line 4 and mechanically connects the housing 2 to the line 4. The housing 2 is pressed together with a casing 8 of the line 4. The casing 8 covers a shield 30 of the line 4. In an embodiment, the casing 8 is formed of a plastic or an elastomer. In the shown embodiment, the line 4 has two electrical conductors 26, shown in FIG. 3B, arranged parallel to each other in the line 4 and stripped at an end. The conductors 26, in an embodiment, can be formed of copper or a copper alloy.

The overlapping region 6 forms an end section of the housing 2. As shown in FIG. 1, a grip region 10 of the housing 2 is arranged adjacent to the overlapping region 6. The grip region 10 has a hexagonal cross-section in some regions and, as a result, the housing 2 can be held securely and inserted by a user.

Figure 2:
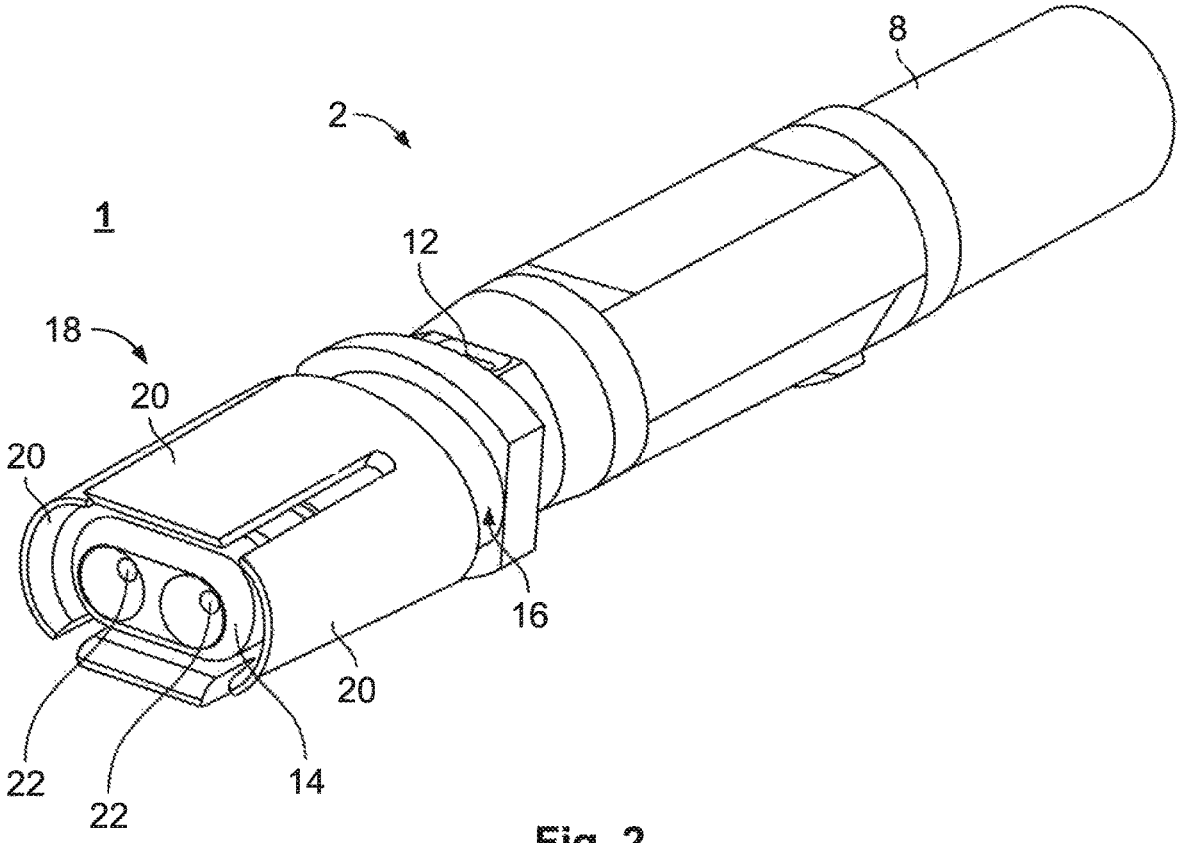
FIG. 2 is a front perspective view of the plug connector.
Figure 3A:
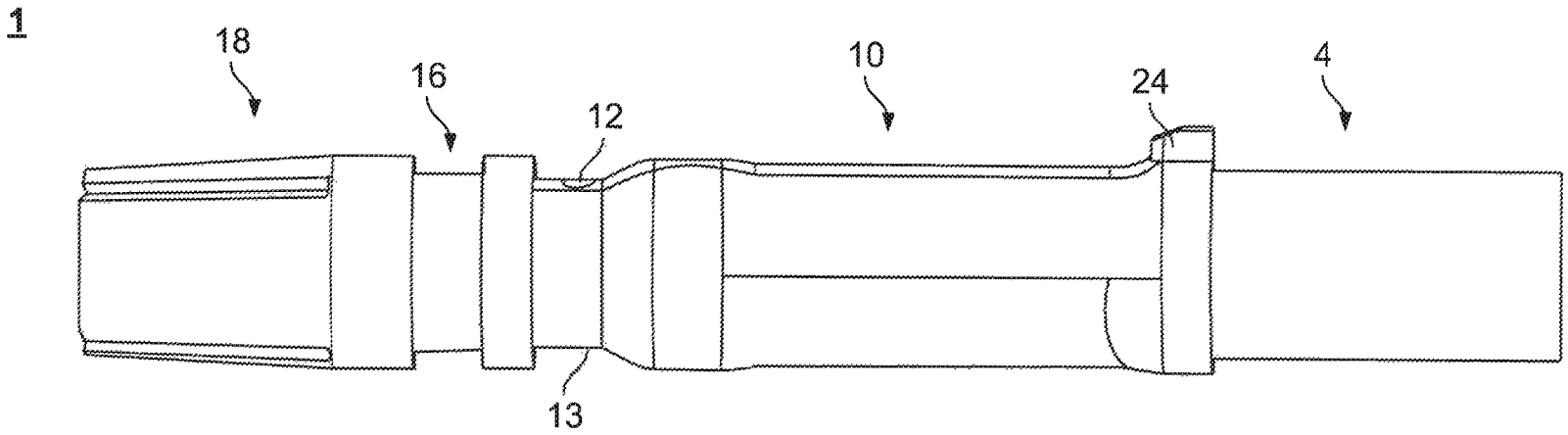
FIG. 3A is a side view of the plug connector.
Figure 3B:
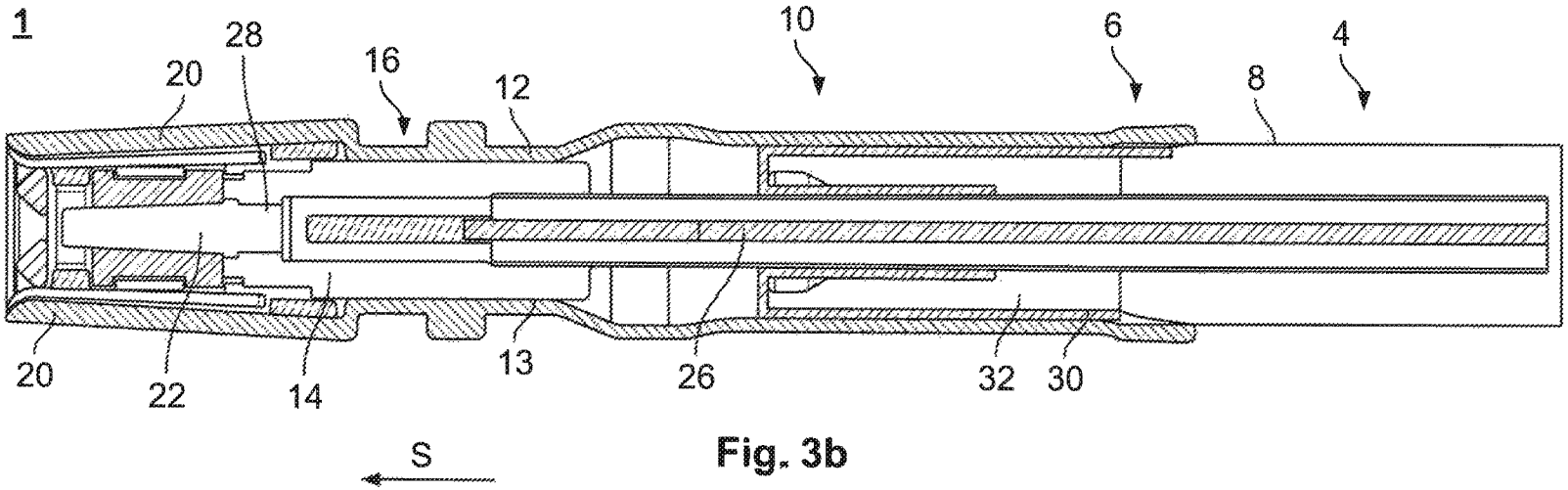
FIG. 3B is a sectional side view of the plug connector.

At an end opposite to the overlapping region 6, the grip region 10 has a region with a marking 12, as shown in FIGS. 1 and 2. As shown in FIGS. 3A and 3B and described in greater detail below, the plug connector 1 has two markings 12, 13 arranged on respectively opposite sides of the housing 2. The side of the housing 2 visible in FIG. 1 has an oval-shaped marking 12. In other embodiments, the marking 12, 13 could be a circle, a square, a rectangle, a triangle, or a dash. The marking 12, 13 can be continuous, dashed, or dotted in various embodiments.

In the embodiment shown in FIGS. 1 and 2, the marking 12 is a recess in the housing 2. The recess of the marking 12 may be stamped or embossed into the housing 2. By way of the recess, an insulator 14 received by the housing 2 is visible. In an embodiment, the insulator 14 has a different color that the housing 2, so that the marking 12 is visually more clearly set apart from the housing 2. The recess and the material thickness of the housing 2 make the marking 12 haptically perceptible by the user. The marking 12 indicates a first plug orientation of the plug connector 1, and can thus also be felt, and thus recognized, by the user in a dark working environment or restricted spatial conditions. In other embodiments, the marking 12 may be adhesively bonded to the housing 2.

The marking 12, 13 can, in various embodiments, be introduced into the housing 2 by lasers, stamping devices, milling machines, and the like. In an embodiment, before recasting of a metal sheet to form the elongate and cylindrical housing 2, the marking 12, 13 can already be introduced into the respective positions of the housing 2.

The grip region 10 of the housing 2, as shown in FIGS. 1 and 2, ends with a circumferentially continuous locking groove 16. The locking groove 16 can be used to lock the plug connector 1 in a coupler or a bushing in the plugged-in state, so that unintentional detaching of the plug connector 1 is prevented.

Adjoining the circumferentially continuous locking groove 16, the housing 2 or plug connector 1 has a connecting region 18 shown in FIGS. 1 and 2. The connecting region 18 is composed of four elastically deformable lamellae 20, which are spaced apart from each other by incisions. The lamellae 20 are arranged spaced apart from the insulator 14, whereby a receiving space is formed between the insulator 14 and the lamellae 20 in the connecting region 18 for receiving the bushing or coupler in some regions.

In the connecting region 18, as shown in FIG. 2, the insulator 14 has two recesses at an end each receiving an end sleeve 22. The receptacles for the end sleeves 22 in the insulator 14 are rounded and widened conically at the end, such that when the plug connector 1 is plugged, contact pins of the bushing or of the coupler can extend into the end sleeves 22 in a manner led through the insulator 14. In connecting the plug connector 1 to a bushing or coupler, the end sleeves 22 are expanded by the contact pins, as a result of which a press-on force onto the contact pins can be produced and an improved electrical transition resistance can be produced between the electrical conductors 26.

Two markings 12, 13 for visually and haptically denoting two different plug orientations of the plug connector 1 are shown in FIGS. 3A and 3B. On the opposite side of the housing 2 from the oval-shaped marking 12, the plug connector 1 has a circular marking 13. In order to be able to clearly tell the difference between the two markings 12, 13, the circular marking 13 is smaller than the oval-shaped marking 12. The marking 13 otherwise shares the same characteristics as the marking 12 with respect to the housing 2.

A circumferential guiding tongue 24 of the housing 2, shown in FIG. 3A, is arranged in the overlapping region 6 of the housing 2 with the line 4 and adapted to guide insertion of the plug connector 1. The guiding tongue 24 is arranged, for example, orthogonal to the electrical conductors 26. The guiding tongue 24 serves, in particular, to align the at least two end sleeves 22 of the electrical conductors 26 in a manner that matches a corresponding arrangement of contact pins of the bushing or coupler when plugged together with the plug connector 1. The bushing or coupler can have at least one guide groove for receiving the guiding tongue 24. In an embodiment, the guiding tongue 24 can be used to enter a releasable mechanical latching connection and unintentional detaching of the plug connector 1 from the bushing or coupler can be prevented.

As shown in FIG. 3B, the insulator 14 is inserted into the housing 2 in an interlocking manner in the region of the connecting region 18. In another embodiment, the insulator 14 is held frictionally in the housing 2. The insulator 14 is arranged in a torsion-resistant manner in the housing 2. The insulator 14 has, at least in some regions, an oval cross-section corresponding to a regional cross-section of the housing 2. The insulator 14 receives the end sleeves 22 of two electrical conductors 26. The end sleeves 22 are crimped or soldered onto an end of each of the electrical conductors 26. The end sleeves 22 are inserted in the insulator 14 via latching noses 28 and are thus locked in a stationary manner in the insulator 14. The end sleeves 22 are designed in several parts and in an elastically expandable manner, as a result of which an optimal electrical conductivity can be implemented when the plug connector 1 is plugged together with the bushing or the coupler. Depending on the plug orientation, the polarity of the end sleeves 22 or the electrical conductors 26 can be reversed or commutated.

As shown in FIG. 3B, the housing 2 is electrically conductively connected in the overlapping region 6 to the shield 30. The shield 30 is clamped between the housing 2 and the casing 8. In mounting the line 4 at the plug connector 1, the casing 8 can be removed at an end of the line 4, exposing the shield 30. The exposed shield 30 can then be bent back or reversed counter to the plugging direction S of the plug connector 1. In an embodiment, the shield 30 is an electrically conductive wire mesh exposed at an end of the line 4 and which has been reversed and covered by a sleeve 32 alternatively counter to the plugging direction S of the plug connector 1.

Figure 4A:
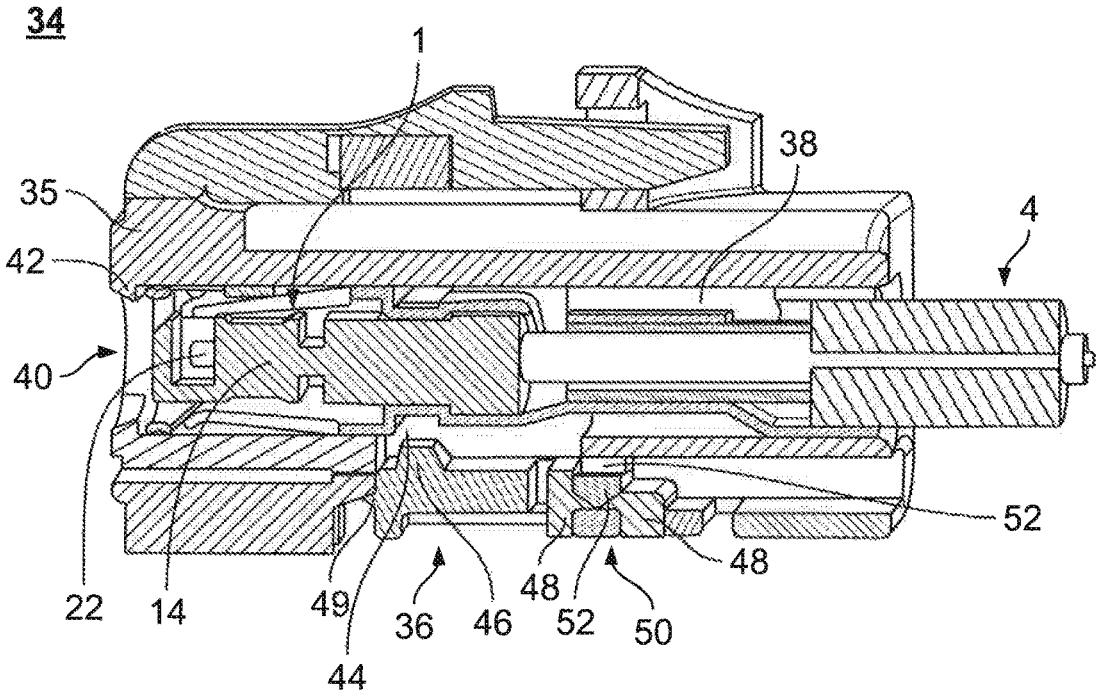
FIG. 4A is a sectional side view of a plug connector receptacle receiving the plug connector with a retaining device of the plug connector receptacle in an open position.
Figure 4B:
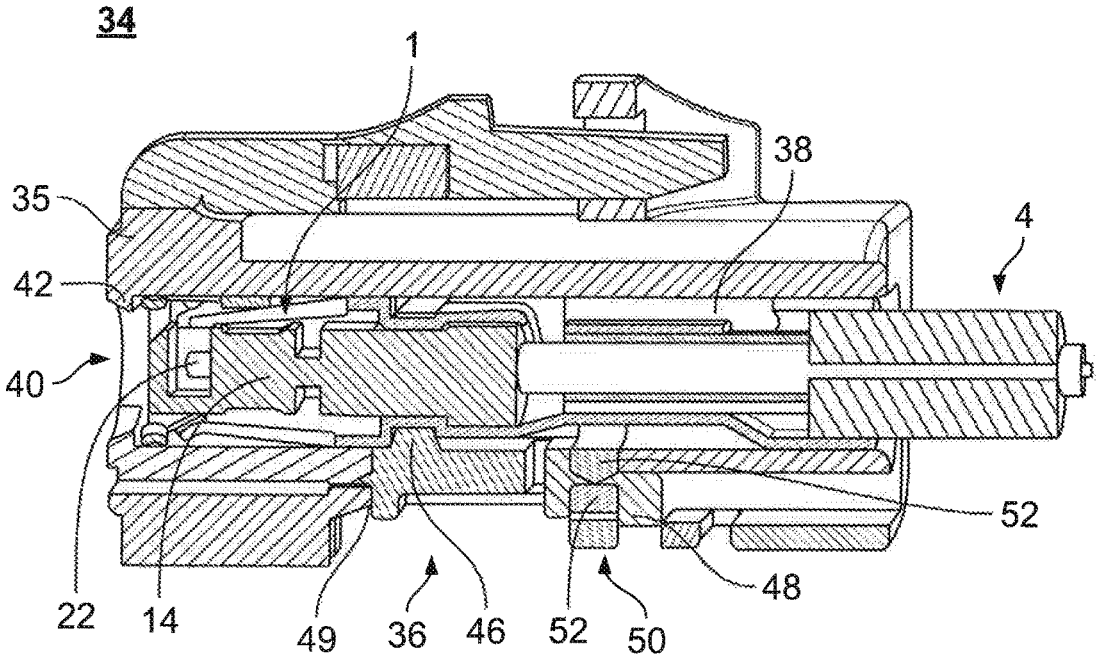
FIG. 4B is a sectional side view of the plug connector receptacle with the retaining device in a closed position.

The plug connector 1 is insertable into a plug connector receptacle 34 shown in FIGS. 4A and 4B. The plug connector receptacle 34 has a housing 35 with a receiving space 38, in which the plug connector 1 is inserted. The receiving space 38 has an insertion opening 40 arranged at the end, oriented in a plugging direction S of the plug connector 1, and exposing the plug connector 1 at the end. Formed around the insertion opening 40 is a circumferential stop 42 or a boundary 42 for limiting a movement of the plug connector 1 at the end within the receiving space 38.

The housing 35, as shown in FIG. 4A, has a retaining opening 44 oriented orthogonal to a plugging direction S. The retaining opening 44 receives and guides a retaining tongue 46 of a retaining device 36 of the receptacle 34 that is movable between an open position and a closed position. The retaining tongue 46 is directed into the receiving space 38 and, as shown in FIG. 4B, can project into the receiving space 38 in the closed state of the retaining device 36.

Figure 5:
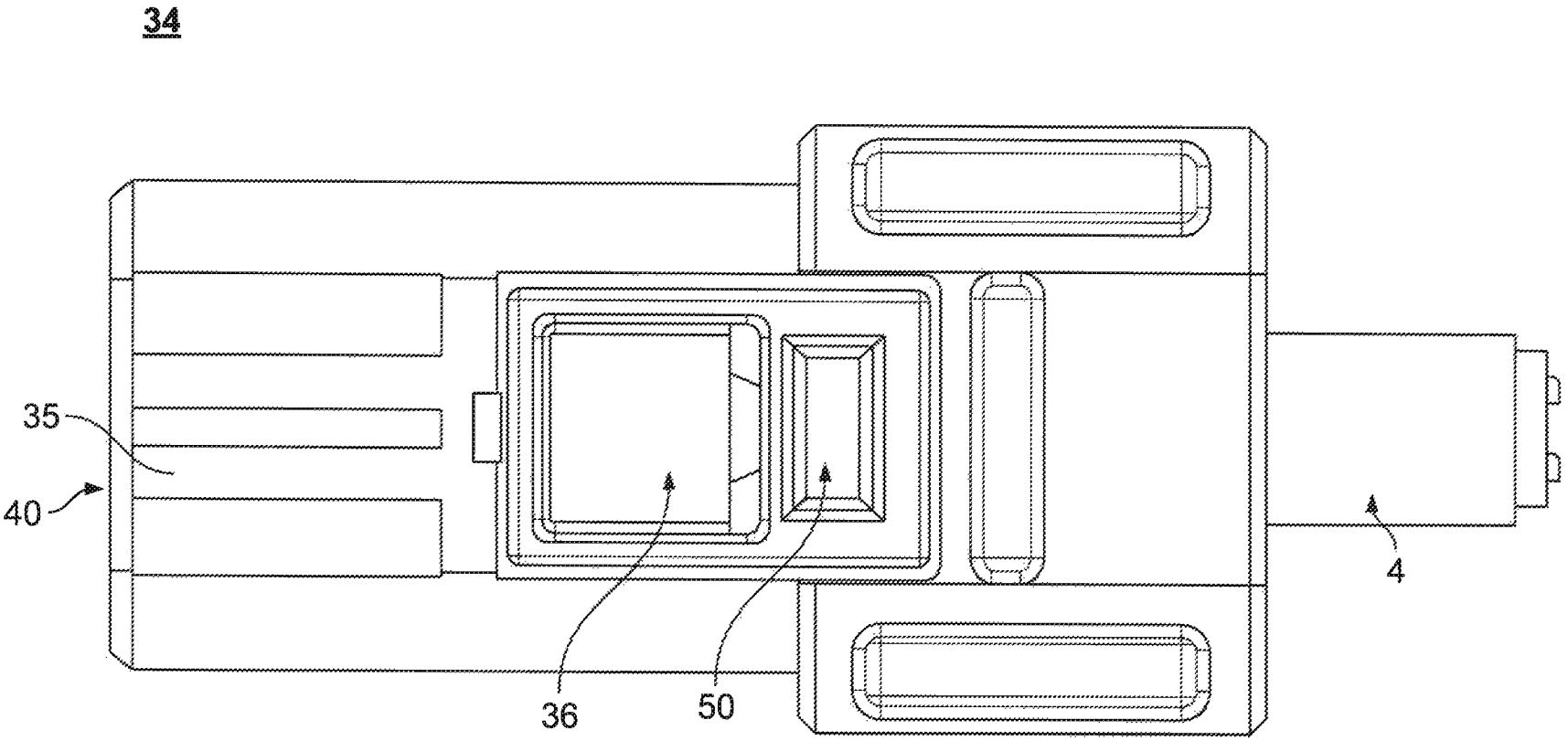
FIG. 5 is a plan view of the plug connector receptacle.

The retaining device 36, as shown in FIGS. 4A and 4B, has three latching noses 48, 49 aligned orthogonal to the direction of movement of the retaining tongue 46. Two latching noses 48 are aligned with each other and enclose a housing section 50 extending orthogonally out from a plugging direction S and having a pair of through-holes 52. The through-holes 52 are latching grooves for the latching noses 48 of the retaining device 36. The retaining device 36 can thus be positioned in two defined latching positions, the open position or the closed position, at the housing section 50. A third latching nose 49 uniformly locks the retaining device 36 in a closed position. As shown in FIG. 5, the retaining device 36 grips the housing section 50 and can thus remain in an opened and a closed position at the housing 35.

In the open position of the retaining device 36, shown in FIG. 4A, the latching noses 48, 49 latch to the housing section 50 and prevent accidental withdrawal of the retaining device 36 prior to insertion of the plug connector 1. In the closed position of the retaining device 36, shown in FIG. 4B, the retaining tongue 46 projects through the retaining opening 44 into the receiving space 38, and into the circumferential latching groove 16 when a plug connector 1 is inserted. The plug connector 1 is thereby fixed in an interlocking manner in the receiving space 38.

What is claimed is:

1. A plug connector for electrically and mechanically connecting a pair of electrical conductors of a line, comprising:

an insulator receiving and positioning a pair of end sleeves each connected to one of the electrical conductors; and a housing receiving the insulator, the housing having a plurality of plug orientations each visually and haptically denoted by one of a plurality of markings in a grip region of the housing.

2. The plug connector of claim 1, wherein the marking of at least one of the plug orientations is a circle, an oval, a square, a triangle, or a dash.

3. The plug connector of claim 1, wherein the marking of at least one of the plug orientations is stamped into the housing, embossed into the housing, or adhesively bonded onto the housing.

4. The plug connector of claim 1, wherein the housing has an elongated shape with a circumferentially continuous locking groove.

5. The plug connector of claim 4, wherein the circumferentially continuous locking groove is arranged between the grip region and a connecting region of the housing.

6. The plug connector of claim 1, wherein the end sleeves are locked in the insulator in a stationary manner.

7. The plug connector of claim 1, wherein the line has a shield exposed at an end of the line and enclosing the electrical conductors.

8. The plug connector of claim 7, wherein the housing is electrically conductive and is electrically connected to the shield.

9. The plug connector of claim 1, wherein the housing is elastically expandable in a connecting region of the housing.

10. The plug connector of claim 9, wherein the housing has, at an end opposite the connecting region, a circumferential guiding tongue adapted to guide the plug connector.

11. The plug connector of claim 1, wherein the end sleeves are elastically expandable.

12. The plug connector of claim 1, wherein the insulator is capable of being locked in the housing.

13. The plug connector of claim 1, wherein the insulator is arranged in a torsion-resistant manner in the housing.

14. The plug connector of claim 1, wherein the line has a casing and the housing is adapted to be mechanically clamped to the casing.

15. A plug connector receptacle for receiving a plug connector, comprising:

a housing having a receiving space adapted to receive and position the plug connector, the housing having an insertion opening oriented in a plugging direction of the plug connector and exposing an end of the plug connector; and a retaining device adapted to lock the plug connector inserted in the receiving space, the retaining device having a retaining tongue interlocking with a locking groove of the plug connector and a pair of latching noses engaging a housing section of the housing, the retaining device can be locked in an open position or a closed position at the housing section with the latching noses.

16. The plug connector of claim 1, wherein the plurality of markings each have a different shape.

17. The plug connector of claim 1, wherein each of the plurality of plug orientations is a different rotational orientation of the housing.

* * * * *